United States Patent [19]

Schmidt et al.

[11] 4,440,242

[45] Apr. 3, 1984

[54] DEVICE FOR PRODUCING BOREHOLES IN COAL OR THE LIKE

[76] Inventors: Bruno H. Schmidt, Niederkasseler Kirchweg 34, 4000 Düsseldorf; Helmut Becker, Grosser Schirmkamp 17, 4300 Essen, both of Fed. Rep. of Germany

[21] Appl. No.: 327,891

[22] Filed: Nov. 24, 1981

[30] Foreign Application Priority Data

Nov. 25, 1980 [DE] Fed. Rep. of Germany ..... 3044263

[51] Int. Cl.[3] ..... E21B 7/18

[52] U.S. Cl. ..... 175/107; 175/67; 415/80; 415/502

[58] Field of Search ..... 175/107, 67, 103, 220, 175/422; 415/80, 82, 502, 503; 239/240, 246

[56] References Cited

U.S. PATENT DOCUMENTS

| | | | |
|---|---|---|---|
| 1,860,214 | 5/1932 | Yeaman | 175/107 |
| 2,950,087 | 8/1960 | Gregory | 175/103 |
| 3,576,222 | 4/1971 | Acheson et al. | 175/422 X |
| 3,844,362 | 10/1974 | Elbert et al. | 173/159 X |
| 4,003,673 | 1/1977 | Eskeli | 415/80 |
| 4,012,164 | 3/1977 | Eskeli | 415/80 X |
| 4,333,539 | 6/1982 | Lyons et al. | 175/107 X |

*Primary Examiner*—Ernest R. Purser
*Assistant Examiner*—Thuy M. Bui

[57] ABSTRACT

Apparatus for drilling geological formations includes a hydraulic motor through which a high pressure fluid is delivered to plural nozzles which define material cutting jets. A portion of the fluid supplied to the motor is diverted and employed to generate a torque which causes the rotation of the rotor of the motor which is mechanically connected to the drill head which includes the cutting jet defining nozzles. The apparatus is connected, typically by means of a hose, to a source of pressurized fluid and thrust nozzles maintain the correct position of the motor and associated drill during the boring operation.

16 Claims, 2 Drawing Figures

DEVICE FOR PRODUCING BOREHOLES IN COAL OR THE LIKE

BACKGROUND OF THE INVENTION (1) Field of the Invention

The present invention relates to the drilling of geological formations and particularly to the perforation of the face of a coal seam. More specifically, this invention is directed to apparatus for forming boreholes in coal or the like and especially to hydraulic drilling apparatus. Accordingly, the general objects of the present invention are to provide novel and improved methods and apparatus of such character.

(2) Description of the Prior Art

While not limited thereto in its utility, the present invention is particularly well suited for use in the mining of coal and especially in the formation of boreholes in the exposed face of a coal seam. The conventional method of forming such boreholes, which may be employed for the placement of explosives, has been conventional mechanical drilling employing a spiral boring bar. Such boring bars may have a rod length of 1.5 m and be rotated either manually or by a carriage-mounted boring machine. If a boring machine is employed, the machine will be advanced towards the coal face either by hand or by a pneumatic drive.

Hand boring is a very laborious task, particularly in hard coal or other coals which can be bored only with difficulty. The use of carriage-mounted boring machines is often precluded by a lack of space and/or time.

In the interest of overcoming the problems briefly discussed above, it has been proposed to employ a high pressure jet of water to form holes in a geological formation, particularly a coal face. Such proposed hydraulic drilling apparatus would employ a stationary nozzle to which the high pressure water was delivered via a conduit. The use of such water jets emanating from stationary nozzles has not proven to be a successful approach. It has additionally been proposed to modify the previously employed carriage-mounted boring machines so that the drill bit was replaced by a combined flushing and boring bit comprising nozzles to which high pressure water was delivered. Such modified apparatus would utilize a special rotatable boring bar, which was expensive to produce, which could tolerate the water pressures of up to 350 bars. In addition, specially designed high pressure flushing heads would be required in order to insure that the water would penetrate into the bar which was rotated during the boring operation. The replacement of a mechanical boring bit by a nozzle head, which was itself mechanically rotated, will not result in any advantage or operational progress when compared to simple mechanical drilling.

SUMMARY OF THE INVENTION

The present invention overcomes the above-discussed and other deficiencies and disadvantages of the prior art and, in so doing, provides apparatus for forming boreholes in geological formations. Apparatus in accordance with the invention is characterized by simplicity, reliability and moderate cost. These improvements are embodied in a novel hydraulic drill which receives all of the necessary energy for operation from a conventional, and customarily available, source of high pressure fluid.

Apparatus in accordance with the preferred embodiment of the present invention comprises a boring head which includes a hydraulic motor driven by high-pressure water. The hydraulic motor converts a portion of the energy of the water supplied to the apparatus to rotary motion. This rotary motion is delivered to a hydraulic drill comprising a plurality of nozzles which form high pressure jets which are caused to impinge upon the surface to be drilled. The hydraulic motor includes discharge ports through which a portion of the high pressure water supplied to the apparatus is discharged at an angle with respect to the axis of the motor. This angular discharge exerts a torque on the rotatable portion of the motor to thereby produce the rotation thereof. Apparatus in accordance with a preferred embodiment of the invention may also comprise means for guiding the boring head in the borehole and thrust nozzles which serve to equalize the axial forces on the hydraulic motor rotor.

Thus, to summarize, apparatus in accordance with the present invention may be employed to produce boreholes in geological formations and comprises a boring head including a hydraulic motor intended to be connected to a pressurized source of water. This hydraulic motor has a rotatable member which is coupled to a head or drill from which the pressurized water emerges, preferably as plural jets, to perform the boring operation. The hydraulic motor also includes discharge ports from which a portion of the water supplied thereto is discharged in such a manner as to generate a torque which causes the rotation of the rotatable element of the motor.

BRIEF DESCRIPTION OF THE DRAWING

The present invention may be better understood and its numerous objects and advantages will become apparent to those skilled in the art by reference to the accompanying drawing in which.

DESCRIPTION OF THE PREFERRED EMBODIMENT

Figure 1:
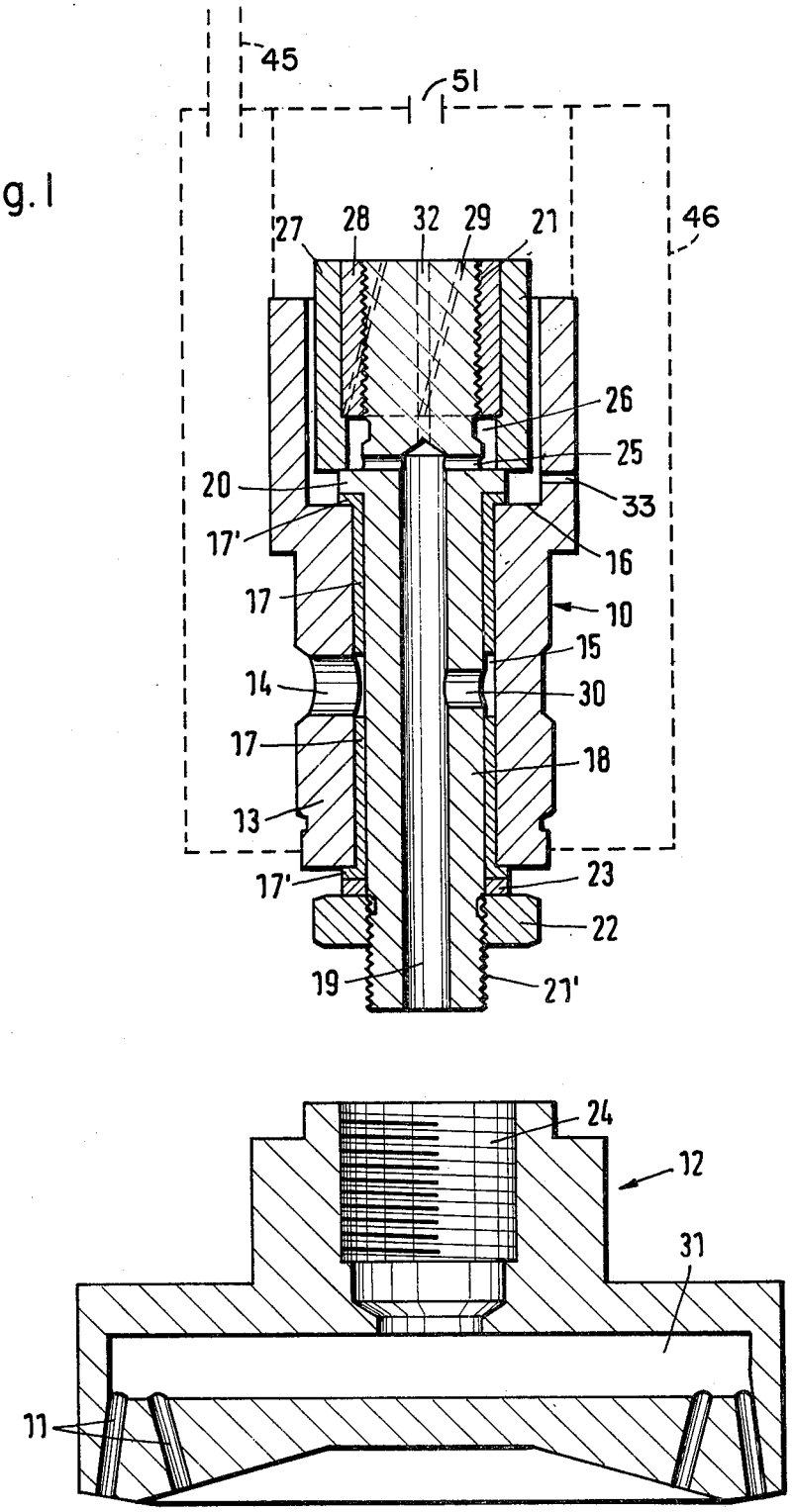
FIG. 1 is a cross-sectional side elevation view of drilling apparatus in accordance with a preferred embodiment of the invention, the housing for the motor portion of the apparatus having been omitted from FIG. 1.

With reference to FIG. 1, apparatus in accordance with the present invention comprises two basic subsystems. The first of these subsystems is a hydraulic motor which is indicated generally at 10. Hydraulic motor 10 is coupled to a drilling head which is indicated generally at 12 on a slightly enlarged scale when compared to the showing of motor 10. The drilling head 12 includes a plurality of nozzles 11 which define the jets of high pressure fluid which impinge on and thus cut the material which comprises the formation being drilled.

The hydraulic motor 10 comprises a casing 13 which should not be confused with an outer housing, indicated in phantom, through which the hydraulic fluid is delivered to the apparatus. Casing 13 will be provided with one or more radially oriented supply ports 14 through which the pressurized water or other fluid is delivered into the cylindrical central bore 15 defined by casing 13. The central bore 15, and thus also the casing 13, is provided with an upper portion of increased diameter which is, in part, defined by a shoulder 16. A pair of bushings 17 are inserted into the bore 15 of casing 13 from the opposite ends thereof. The bushing 17 are each provided with an outwardly extending flange 17'. These flanges respectively contact the shoulder 16 and the end of casing 13 disposed opposite to shoulder 16 and thus determine the limits of insertion of the bushings. The length of the bushings is selected such that they terminate short of the supply ports 14 whereby the inflow of the pressurized hydraulic fluid is not impeded by the bushings.

The bushings 17 guide an inwardly disposed member 18 which, in the embodiment being described, functions as the rotor of motor 10. Rotor 18 is provided with an axially extending blind bore 19 which is open at the front or lower end of motor 10. Rotor 18 is also provided with an outwardly extending flange 20 which rests on the flange 17' of the upper one of the two bushings 17. The rotor 18 is provided with a portion which extends above flange 20 and which, in part, has an external thread 21. The opposite end of rotor 18 is also provided with an external thread 21'. Rotor 18 is retained within casing 13 by means of a nut 22, which engages the thread at the lower end thereof, and a washer 23 which contacts the nut 22 and the flange 17' on the lower of the bushings 17. A portion of the threaded lower end of rotor 18 projects beyond nut 22 and engages a complimentary internal thread of an axial bore 24 in the drill head 12. The nut 22 also serves as a lock nut for drill head 12.

The axial blind hole 19 in rotor 18 is provided, adjacent the inwardly disposed end thereof, with a plurality of radially outwardly extending passages 25. Passages 25 terminate in an annular chamber 26 which is defined by the flange 20 on rotor 18, the body of the rotor above the flange and a pair of sleeves 27 and 28. The outer of sleeves 27 and 28 contacts the upper surface of flange 20 of rotor 18 and is captured by the internally threaded inner flange 28 which engages the thread 21 at the upper end of rotor 18. A plurality of discharge passages or ports 29 extend from annular chamber 26 to the upper end of rotor 18. The discharge passages 29 are preferably defined by helical or spiral grooves formed in the outer surface of sleeve 28. The passages 29 discharge pressurized fluid in an axially inclined direction into the housing and these discharges generate a reaction force having a radial component. The axial bore 19 of rotor 18 is also intercepted by one or more radial passages 30 at a point intermediate its length. The passage or passages 30 establish communication between the supply ports 14 and the axial bore 19 via the central bore 15 of casing 13. The rotor 18 will be supported within the casing 13 so as to be free to rotate, i.e., there will be both radial and axial clearance between the stationary and relatively movable components of motor 10.

The drill head 12, which defines the nozzles 11, will include a radially extending bore or chamber 31 which establishes fluid communication between the threaded bore 24 and nozzles 11. Accordingly, fluid supplied to motor 10 via supply ports 14 will flow down the axial bore 19 of rotor 18 to drill head 12 and thence to nozzles 11 and will also flow upwardly in bore 19 for discharge via passages 29 to generate a rotation causing force.

The motor 10 as depicted in FIG. 1 will, of course, be mounted within a holder or housing through which the high pressure water feed takes place. As noted, the high pressure water will enter the central bore 15 through the supply ports 14 and, via the axial passages 30, will flow into the bore 19 of rotor 18. The high pressure water flowing into bore 19 will be directed both to the nozzles 11, from which it emerges as high-pressure water jets, and through passages 25 to the annular chamber 26 from which it is discharged via the angularly inclined passages 29. Because of the inclination of the passages 29, the high pressure water flowing therethrough will exert a torque on rotor 18 and the rotor will thus be set into rotational motion. As a result of the rotation of rotor 18, the drill head 12, and thus the nozzles 11, will also rotate.

In addition to the inclined discharge passages 29, rotor 18 may also be provided with a small diameter central axial discharge passage 32 which communicates with bore 19. If passage 32 is present the discharge therefrom will provide a reaction force which compensates for any axial force imbalance between the upward force produced by the discharge from nozzles 11 and any downward component of force resulting from the discharge from the inclined passages 29. Thus, the inclusion and sizing of passage 32 will insure that rotor 18 "floats" in casing 13. This force compensation may also be achieved through the sizing and adjustment of the discharge angle of the passages 29.

The hydraulic fluid delivered to motor 10 also serves to lubricate the rotor 18. Accordingly, the rotor 18 need not be mounted in bearings. Similarly, seals are not required since the fluid delivered to the motor is allowed to flow out freely. In order to insure that no ramming pressure arises during starting, and thus in order to prevent any axial rearward thrust, an opening 33 may be provided in casing 13 in the region of shoulder 16.

The rotational speed of rotor 18 will be a function of the number and inclination of the passages 29 and the pressure of the fluid delivered to the motor. Rotational speeds exceeding 5,000 rpm, in fact speeds on the order of magnitude of 10,000 to 20,000 rpm can readily be obtained. The source pressure of the water delivered to motor 10 will typically be in the range of 300 to 500 bars, but could be in excess of 1,000 bars.

In the disclosed embodiment, the drill head 12 comprises a first pair of oppositely disposed nozzles 11, which have their axes inclined slightly outwardly with respect to the axis of the motor, and two further nozzles which have their axes inclined slightly inwardly toward the axis of the motor, the angles of inclination being stated in respect to the direction of fluid flow through the nozzles. The nozzles 11 are disposed symmetrically about the axis of the motor. The diameter of the hole which is bored is determined by the positioning and inclination angle of the outer nozzles in drill head 12. The inner nozzles, i.e., the nozzles which discharge at an inwardly inclined angle, serve to shatter the bore core. The outer configuration of the drill head 12 may be cylindrical. However, to allow for the removal of the material which is separated from the formation being drilled, it is desirable for the drill head 12 to deviate from the cylindrical shape and, for example, to have a rectangular cross-section. It is also to be noted that the nozzles 11 need not be disposed symmetrically about the axes of the device. Thus, it is possible to employ only a single pair of oppositely inclined nozzles at one side of the drill head.

Should the rotational speed of motor 10 prove to be too great, which may be the case when the passages 29 are employed to achieve the axial force balance, it is possible to employ one or more discharge passages 29 which have an inclination which is opposite to the other passages to thereby limit the rotational speed. As noted above, the sizing and number of the passages 29 may be selected primarily to achieve the desired rotational speed and axial reaction compensation achieved through the use of the bore 32.

It will also be apparent to those skilled in the art that the discharge passages 29 may be arranged in a radial plane such that the discharge therefrom would be in the lateral direction with no axial force component being produced. The discharge passages 29 may also tangentially discharge into the housing.

It is, of course, also possible to restrain the member 18 from rotation whereupon the casing 13 will become the rotor which, of course, will be mechanically connected to the drill head 12 and will be provided with the discharge passages 29.

Figure 2:
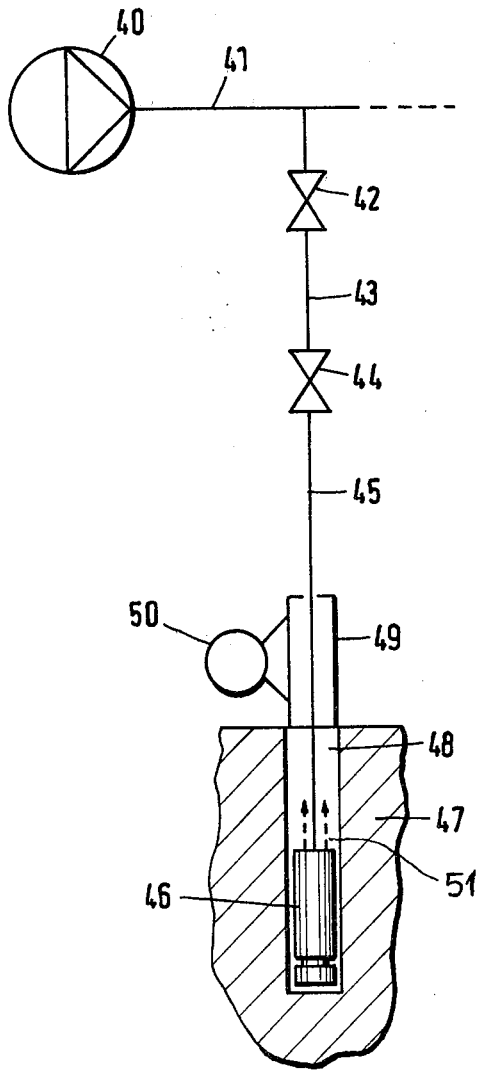
FIG. 2 is a schematic diagram which illustrates the use of the apparatus of FIG. 1.

Referring now to FIG. 2, a source of highly pressurized fluid, typically water, is indicated at 40. Source 40 is coupled, via a hose or conduit 41, to a valve 42. The downstream side of valve 42 is, in turn, coupled to a fast-acting control valve 44 by means of a high-pressure hose 43. Valve 44 can be operated either by hand or foot. The downstream side of control valve 44 is connected, by means of a further high-pressure hose 45, to the housing of the apparatus of FIG. 1, the housing being indicated in FIG. 2. The apparatus 46, i.e., the complete boring head, is employed to form boreholes, such as indicated at 48, in material 47 which may, for example, be a coal face. The boring head is supported in a tubular guide device 49. By providing one or more nozzle-shaped high pressure discharge ports, indicated schematically at 51, in the housing 46 of the boring head, these further discharge ports 51 being oriented in the opposite direction to the desired drilling direction as indicated by arrows on FIG. 2, a propelling thrust may be generated so that the boring head together with the high-pressure hose 45 connected thereto is able to position itself and generate a forward feed thrust toward the formation 47. Since the rotor 18 of the boring head is reaction-compensated, the boring head may slide into a previously drilled borehole 48 without any additional aid to maintain the apparatus in the correct position for the boring operation.

In order to commence the boring of a new borehole 48, the guide 49 may be used. The guide 49 holds the boring head for movement therein and determines the drilling direction. The guide 49 may, for example, be mounted on a support 50 which is adjustable in height and possibly also in angular orientation.

The water containing the cuttings, which leaves the borehole 48, is collected in the tubular guide 49 and, by means not shown in the drawing, lead away from the apparatus. The guide 49 thus preferably remains associated with the boring head during the entire drilling operation. As indicated in FIG. 2, the hose 45 passes through the guide 49 to the boring head.

As explained above, the cutting nozzles, i.e., the drill head 12 of FIG. 1, are set into rotation by means of a diverted portion of the high pressure hydraulic fluid delivered to the hydraulic motor. With such a hydraulic motor, very high rotational speeds can be obtained, these speeds exceeding 5,000 rpm and generally being in the range of 10,000 to 20,000 rpm. This high speed rotation of the jets of water which perform the cutting function leads to a substantially improved cutting action and this, in turn, leads to a substantially lower expenditure of energy for a given drilling operation and a substantially increased drilling speed. The rotational speed of the drill head can, as noted above, be controlled by the positioning and configuration of the discharge passages 29 and by controlling the supply pressure. A particularly significant aspect of the present invention resides in the fact that the hydraulic motor 10 is of uncomplicated construction, and thus of comparatively modest cost. This is particularly important since, under mining conditions, there is the ever present danger of loss of the apparatus. The unique construction of the hydraulic motor of the drilling device of the present invention also permits a floating support of the motor rotor and eliminates the need for bearings and seals. As also noted above, while the cutting jet forming nozzles can be arranged symmetrically with respect to the axis of the apparatus, an increased point-force can be achieved by a non-symmetrical, and particularly a one-sided, arrangement.

The high-pressure water or other hydraulic fluid is, in accordance with the present invention, used simultaneously for cutting, imparting rotation to the drill and for forward feed of the drill. The forward feed is accomplished by virtue of the above-mentioned thrust nozzles provided in the housing 46 of the boring head. This insures that the head is guided in the borehole. Since the boring head is connected to a high-pressure hose, the problems associated with the manufacture and use of a special rotatable boring bar are eliminated.

In order to start a new borehole, a guide device such as a pipe may be employed. This guide device may, for example, be affixed to an adjustable support. The water which emerges from the borehole, and which contains the drill cuttings, is collected in this guide pipe and lead off. The guide pipe may remain in position during the complete boring operation in which case the high pressure feed hose will by lead through the guide pipe to the boring head.

Employing the apparatus of the present invention it is possible to produce impregnation holes of the requisite diameter with a depth of up to about 50 mm in a very simple and expeditious manner.

In addition, boreholes of great depth, such as those having length exceeding several hundred meters, can be produced employing the present invention. Such long boreholes may, for example, be desired when the depth of a coal face is to be determined. When employing the present invention to drill holes of great depth, problems which have plagued the prior art, particularly those problems associated with off-centering of the bore when using a mechanical boring bar, are eliminated.

While a preferred embodiment has been shown and described, various modifications and substitutions may be made thereto without departing from the spirit and scope of the invention. Thus, while the present invention has been described primarily in connection with the formation of holes in a coal mining operation, it is equally well suited for use in the mining of other materials such as limestone, gypsum or the like for the purpose of producing bores in the rock to be mined. Accordingly, it will be understood that the present invention has been described by way of illustration and not limitation.

What is claimed is:

1. Hydraulic drilling apparatus comprising:

casing means, said stator means having an axis, said stator means defining at least a first fluid flow path;

means coupling said casing means to a source of pressurized fluid; and rotor means positioned coaxially with respect to said casing means, said rotor means having a cutting head at a first end thereof, said cutting head defining a plurality of nozzles which discharge cutting jets from a face thereof, whereby fluid cutting of a medium impinged upon by said jets will be induced, said rotor means further defining a plurality of discharge ports at the end thereof disposed oppositely with respect to said cutting head, at least some of said ports being oriented to provide fluid streams having a component of motion which is angularly related to said axis whereby rotational force will be generated and said rotor means will be caused to rotate relative to said casing means, at least one of said ports being oriented to provide a fluid stream having an axial component of motion whereby an axial force in opposition to axial forces imposed on said rotor as a result of the discharge of said cutting jets will be generated, said generated axial force being substantially equal to said axial forces resulting from the discharge of said cutting jets, said rotor means additionally defining flow passages which establish fluid communication between said casing means defined flow path and said nozzles and ports.

2. The apparatus of claim 1 wherein said coupling means includes:

housing means, at least a portion of the hydraulic motor defined by said casing means and rotor means being positioned within said housing means.

3. The apparatus of claim 2 wherein said housing means is provided with at least a first discharge opening in a first end thereof, said discharge opening being oriented to provide a fluid stream having a component of motion which is parallel to said axis and directed away from the medium impinged upon by said cutting jets whereby a force which advances said cutting head toward the medium will be produced, said housing means further defining a chamber which extablishes fluid communication between said coupling means and said casing means first fluid flow path.

4. The apparatus of claim 3 further comprising:

guide means for said apparatus, said guide means being positionable on the surface of a medium to be drilled by said cutting jets, said guide means receiving and initially supporting said housing means and the hydraulic motor defined by said casing means and rotor means.

5. The apparatus of claim 1 further comprising:

guide means for said apparatus, said guide means being positionable on the surface of a medium to be drilled by said cutting jets, said guide means receiving and initially supporting the hydraulic motor defined by said casing means and rotor means.

6. The apparatus of claim 1 wherein the total cross-sectional area of said discharge ports is approximately equal to the total cross-sectional area of said nozzles.

7. The apparatus of claim 1 wherein said at least some of said ports are sized and the angle of inclination thereof selected such that a desired rotational speed will be produced for the fluid supply pressure.

8. The apparatus of claim 1 wherein said rotor means includes an elongated member having an axial bore, a supply port for establishing fluid communication between said bore and said casing means flow path and wherein said cutting head is removably mounted on a first end of said elongated member.

9. The apparatus of claim 8 wherein said at least one port is defined by a small diameter axial extension of said rotor means axial bore, said extension being sized such that the flow therethrough will generate an axial force which will be substantially equal and opposite to the imbalance between the axial forces imposed on said rotor by the discharge through said nozzles and through said at least some of said ports.

10. The apparatus of claim 8 wherein said cutting head defines a chamber which communicates with said nozzles, said head further defining a passage for establishing communication between said rotor means axial bore and said chamber.

11. The apparatus of claim 10 wherein said rotor means further comprises:

sleeve means mounted on said rotor means elongated member, said sleeve means in part defining said discharge ports, and wherein said rotor means further includes at least a first aperture establishing fluid communication between said axial bore and said sleeve means defined ports.

12. The apparatus of claim 11 further comprising:

guide means for said apparatus, said guide means being positionable on the surface of a medium to be drilled by said cutting jets, said guide means receiving and initially supporting said housing means and the hydraulic motor defined by said casing means and rotor means.

13. The apparatus of claim 11 wherein said coupling means includes:

housing means, at least a portion of the hydraulic motor defined by said casing means and rotor means being positioned within said housing means.

14. The apparatus of claim 13 wherein said housing means is provided with at least a first discharge opening in a first end thereof, said discharge opening being oriented to provide a fluid stream having a component of motion which is parallel to said axis and directed away from the medium impinged upon by said cutting jets whereby a force which advances said cutting head toward the medium will be produced, said housing means further defining a chamber which extablishes fluid communication between said coupling means and said casing means first fluid flow path.

15. The apparatus of claim 14 further comprising:

guide means for said apparatus, said guide means being positionable on the surface of a medium to be drilled by said cutting jets, said guide means receiving and initially supporting said housing means and the hydraulic motor defined by said casing means and rotor means.

16. The apparatus of claim 15 wherein the total cross-sectional area of said discharge ports is approximately equal to the total cross-sectional area of said nozzles.

* * * * *

UNITED STATES PATENT AND TRADEMARK OFFICE

CERTIFICATE OF CORRECTION

PATENT NO. : 4,440,242

DATED : April 3, 1984

INVENTOR(S) : Bruno Schmidt et al

It is certified that error appears in the above-identified patent and that said Letters Patent are hereby corrected as shown below:

Claim 1, lines 2 and 3, change "stator" to -casing-

Signed and Sealed this

*Twenty-fifth* Day of *September 1984*

[SEAL]

*Attest:*

GERALD J. MOSSINGHOFF

*Attesting Officer*

*Commissioner of Patents and Trademarks*